US005302780A

United States Patent [19]

Alfing

[11] Patent Number: 5,302,780

[45] Date of Patent: Apr. 12, 1994

[54] SPLIT COAXIAL CABLE CONDUCTOR AND METHOD OF FABRICATION

[75] Inventor: Norman L. Alfing, Green Valley, Ariz.

[73] Assignee: Hughes Aircraft Company, Los Angeles, Calif.

[21] Appl. No.: 905,601

[22] Filed: Jun. 29, 1992

[51] Int. Cl.[5] ..... H01B 7/00

[52] U.S. Cl. ..... 174/102 R; 174/21 R; 174/21 C; 174/24; 174/28; 174/102 SP

[58] Field of Search ..... 174/102 R, 102 A, 102 SP, 174/24, 28, 21 R, 21 C

[56] References Cited

U.S. PATENT DOCUMENTS

| | | | |
|---|---|---|---|
| 2,115,143 | 4/1938 | Harrison | 174/68.1 |
| 2,335,543 | 11/1943 | Rudd | 174/99 E |
| 3,610,947 | 10/1971 | Stephanides et al. | 174/28 X |
| 3,654,378 | 4/1972 | Rehder | 174/28 X |
| 3,864,507 | 2/1975 | Fox et al. | 174/28 X |
| 4,096,345 | 6/1978 | Kemeny | 174/28 X |
| 5,089,665 | 2/1992 | Thuries | 174/28 X |
| 5,126,507 | 6/1992 | Kirma | 174/102 R |

FOREIGN PATENT DOCUMENTS

| | | | |
|---|---|---|---|
| 829941 | 11/1936 | France | 174/28 |
| 365762 | 4/1973 | U.S.S.R. | 174/28 |
| 526702 | 9/1940 | United Kingdom | 174/28 |

*Primary Examiner*—Morris H. Nimmo
*Attorney, Agent, or Firm*—Randall M. Heald; Charles D. Brown; Wanda K. Denson-Low

[57] ABSTRACT

A coaxial cable conductor (20) comprises a center conductor (22) having a preselected longitudinal shape and a longitudinally split outer conductor (24). The split outer conductor (24) includes a first partial outer conductor (60) comprising a portion of the circumference of the outer conductor along its longitudinal length and a second partial outer conductor (62) comprising the remaining portion of the circumference of the outer conductor along its longitudinal length and mating with the first partial outer conductor (60) along two joints (64). The two partial outer conductors (60, 62) may be mechanically joined and sealed along the longitudinal joints against leakage of radio frequency energy, as by the application of a conductive coating along the joints. The center conductor (22) is supported within the outer conductor (24) by a plurality of electrically insulating dielectric supports (68), leaving an insulating air gap between the center conductor (22) and the outer conductor (24).

3 Claims, 2 Drawing Sheets

FIG. 1
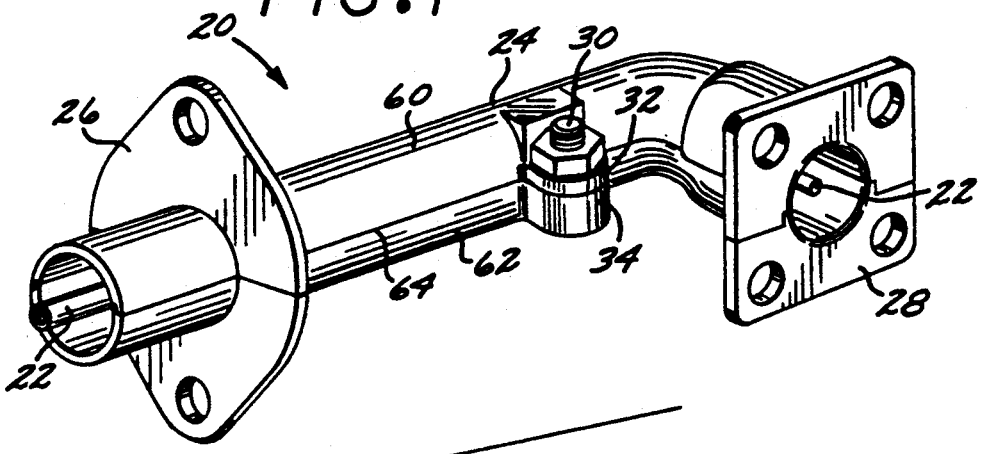
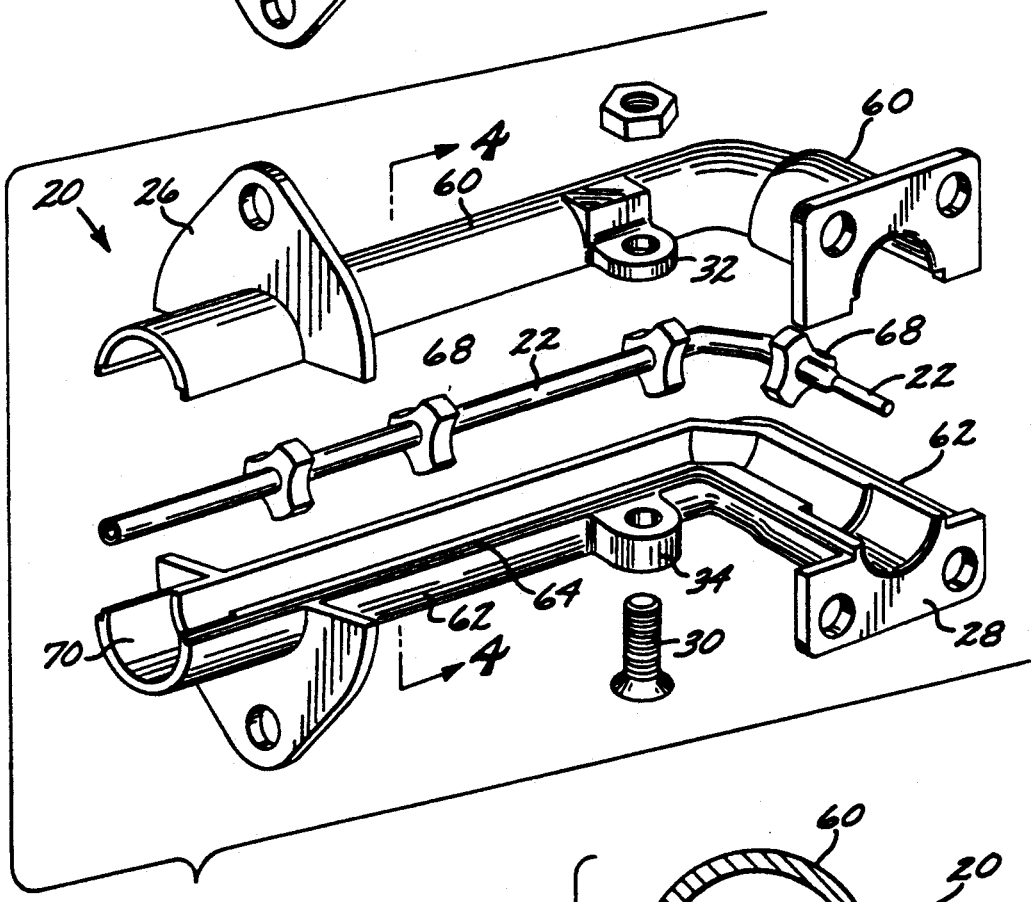
FIG. 3
FIG. 4
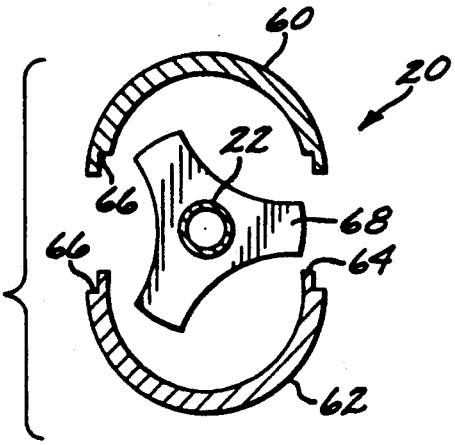

SPLIT COAXIAL CABLE CONDUCTOR AND METHOD OF FABRICATION

BACKGROUND OF THE INVENTION

This invention relates to electrical conductor devices, and, more particularly, to a coaxial cable conductor for high frequency, high voltage electrical feeds.

Many types of devices require high frequency, high voltage power. As an example, a radar-guided missile having an onboard radar transmitter/receiver must have a conductor that conveys such power from a power supply to the radar unit. The radar unit is mounted in the nose of the missile on a gimballed support, and the power supply is located behind the nose. A coaxial cable conductor extends between the two, and conducts the power while permitting the radar unit to be rotated on the gimbal to be aimed at targets. About six separate coaxial cable conductors are required in a typical missile design, ranging from about 1 inch to about 6 inches in length. In some cases the conductors are straight and in other cases have one or more right-angle bends.

The coaxial cable conductor has a solid rodlike center conductor and an outer, hollow cylindrical conductor, with the center conductor centered within the outer conductor by spacers. One type of coaxial cable conductor, termed a semi-rigid coaxial conductor, uses a finned, extruded dielectric material such as teflon which runs the length of the coaxial line assembly. The teflon allows the assembly to be bent into shape while keeping the center conductor centered in place. Connections are soldered or crimped to the ends of the semi-rigid assembly. Because of the large amount of teflon used, this assembly will not handle high power radar energy.

Another type of coaxial cable conductor uses an air dielectric. In the conventional practice for air dielectric coaxial conductor, the coaxial cable conductor is prepared by placing a center conductor with attached spacers into a mold, and filling the mold with wax. The center conductor and wax are removed from the mold. The outer surface of the wax is metallized and electroplated with a copper alloy to form the outer conductor. The wax is removed, and end attachment flanges are affixed to the outer conductor by welding, soldering, or other process.

The process for preparing the air-dielectric coaxial conductor is time consuming and requires extensive handwork, and the resulting coaxial cable conductor is expensive. There is a need for an improved approach to the fabrication of air-insulated coaxial cable conductors. The present invention fulfills this need, and further provides related advantages.

SUMMARY OF THE INVENTION

This invention provides a coaxial cable conductor design and process for its manufacture. The coaxial cable conductor is prepared at a cost of less than 1/10 the cost of the prior approach, yet achieves superior performance and reduced operating temperatures. The coaxial cable conductor of the invention is also lighter and stronger than that made by the prior approach, reduced weight being particularly important for those conductors that are mounted on the gimballing assembly. Reduced weight translates directly into reduced gimballing drive power and support requirements for the gimballed unit.

In accordance with the invention, a coaxial cable conductor comprises a center conductor having a preselected longitudinal shape and a longitudinally split outer conductor. The outer conductor includes a first partial outer conductor comprising a portion of the circumference of the outer conductor along its longitudinal length and a second partial outer conductor comprising the remaining portion of the circumference of the outer conductor along its longitudinal length and mating with the first partial outer conductor along two joints. There is further provided means for joining and for sealing the outer conductor against leakage of radio frequency energy through the two joints. A plurality of electrically insulating dielectric supports center the center conductor within the outer conductor, preventing it from being displaced from the precise central location required for the proper performance of the assembly.

There is also provided a method for preparing such a coaxial cable conductor. In accordance with this aspect of the invention, a method of preparing a coaxial cable conductor comprises the steps of providing a center conductor having a preselected longitudinal shape, casting a first partial outer conductor comprising a portion of the circumference of the outer conductor along its longitudinal length, and casting a second partial outer conductor comprising the remaining portion of the circumference of the outer conductor along its longitudinal length and mating with the first partial outer conductor along two joints. Dielectric supports are placed on the center conductor, and the center conductor is placed within one of the partial outer conductors so that the center conductor is supported on the dielectric supports from touching the outer conductor. The coaxial cable conductor is completed by mechanically joining the two partial outer conductors together and sealing the joints between the two partial outer conductors against leakage of radio frequency energy through the two joints.

The longitudinally split outer conductor is preferably prepared by die casting two partial outer conductors. These pieces are cast to shape, including bends, flanges, and attachments. Standard radio frequency connector can be later attached by soldering or crimping, as necessary. The partial outer conductors are desirably made of an aluminum alloy that can be readily die cast, rather than the copper alloy previously used to permit electroforming of the outer conductor. The result is substantially reduced weight due to the substitution of aluminum for copper, as well as increased strength. Operating temperatures are reduced due to the increased mass of the lighter aluminum. The cost is also lower because die casting of the part, including flanges and attachments, to shape is much less expensive than electroforming and joining the flanges and attachment fitting. Small radius curves are readily made in the cast parts.

One concern with a split outer conductor design is the possible leakage of high frequency energy from the interior of the coaxial conductor. There are no transverse joints, reducing loss from this leakage mode. The necessary longitudinal joints are sealed using several design techniques. In one aspect, the two split outer conductors are made to have different circumferential extents, so that the joints are not diametrically opposite each other across the cylindrical axis of the conductor. In another, the joints are made with a lip design to avoid a straight-through conduction path that permits radio frequency energy leakage. The joints may also be sealed externally with a metallic conductor, as by soldering, welding, or plating, to prevent radio frequency energy leakage. Any or all of these techniques may be used as required to achieve the desired degree of sealing against energy leakage.

This invention provides an advance in the art of design and manufacturing technology for small, complex coaxial cable conductors. Other features and advantages of the invention will be apparent from the following detailed description of the preferred embodiment, taken in conjunction with the accompanying drawings, which illustrate, by way of example, the principles of the invention.

BRIEF DESCRIPTION OF THE DRAWINGS

FIG. 1 is a perspective view of a coaxial cable conductor;

FIG. 3 is an exploded perspective view of the coaxial cable conductor of FIG. 1; and FIG. 4 is a sectional view through the coaxial cable conductor of FIG. 3, in exploded form.

DETAILED DESCRIPTION OF THE INVENTION

Figure 2:
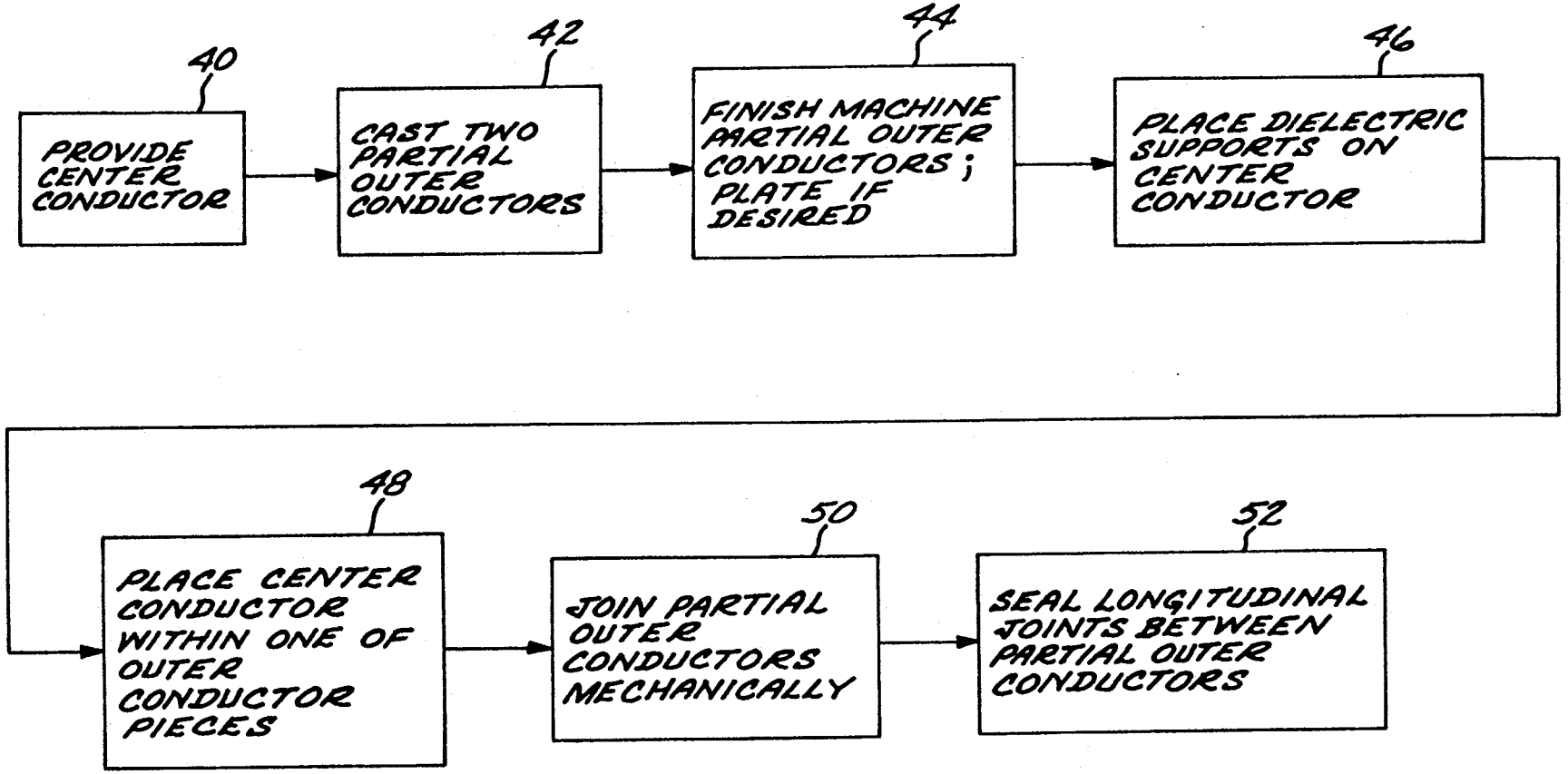
FIG. 2 is a process flow chart for the preparation of the coaxial cable conductor of FIG. 1.

A split coaxial cable conductor 20 is illustrated, in its assembled form, in FIG. 1. The coaxial cable conductor 20 has a center conductor 22 running through the center of a split outer conductor 24. The center conductor 22 runs the length of the interior of the outer conductor 24, as will be seen more clearly in subsequent figures. A flange 26 and a flange 28 are found at each end of the coaxial cable conductor 20. The two pieces of the outer conductor 24 may be mechanically attached with a screw 30 extending through lugs 32 and 34 on each of the pieces.

The fabrication method for the coaxial cable conductor 20 is presented in block diagram form in FIG. 2, and may be understood most clearly by reference to the exploded view of FIG. 3.

The center conductor 22 is first prepared to the required shape, numeral 40 of FIG. 2. The center conductor 22 is a rod, wire, or tube of an electrically conducting material such as copper, aluminum, or brass, which may optionally be coated with an inert material system such as nickel and then gold to improve its radio frequency conduction and to resist oxidation. (As used herein, a named metal is intended to include the pure metal and its alloys. Thus, for example, "aluminum" includes pure aluminum and aluminum-based alloys.) In a typical case, the center conductor 22 has a diameter of about 0.0625 inches. The center conductor 22 is formed to the required longitudinal shape. In the exemplary embodiment of FIG. 3, the center conductor 22 has a single right angle bend, but other more complex shapes have been fabricated.

The outer conductor 24 is formed as two pieces, a first partial outer conductor 60 and a second partial outer conductor 62, split longitudinally. In the preferred approach, the two partial outer conductors are not symmetrical when the coaxial conductor 20 is viewed in transverse section. In sectional view, as in FIG. 4 which is also an exploded view, each of the partial outer conductors 60 and 62 comprises a portion of the circumference of the outer conductor 24. In the preferred structure one of the partial conductors, here the first partial conductor 60, extends over less than half of the circumference of the outer conductor 24, while the second partial conductor 62 extends over more than half of the circumference of the outer conductor 24. Placing the surface of joining 64 asymmetrically in this fashion aids in avoiding radio frequency leakage from the interior of the coaxial conductor 20.

The partial conductors 60 and 62 are preferably formed with a conforming lip 66 at each of the joining surfaces 64. The lip 66 is a step in the radial direction on each of the facing surfaces of the partial conductors 60 and 62 at the periphery of the outer conductor 24. The lip configuration further reduces the possibility of leakage of radio frequency energy from the interior of the coaxial conductor 20.

The partial conductors 60 and 62 are dimensioned as required to carry the radio frequency energy. In a typical case, the partial conductors 60 and 62 are joined to form the coaxial conductor 20 with an outer diameter of about 0.23 inches and a wall thickness of about 0.052 inches. However, these dimensions can vary along the length of the coaxial conductor as may be desirable from a design standpoint.

The two partial conductors 60 and 62 are preferably prepared by die casting, numeral 42 of FIG. 2. Separate molds are prepared that define the features of each of the partial conductors 60 and 62. Molten metal is injected under pressure into the mold cavities. The molten metal solidifies to form as-cast partial conductors. With this approach, the partial conductors 60 and 62 may be fabricated from any metal that can be die cast and has the required properties for the final parts. In the preferred case, the partial conductors 60 and 62 are formed from A380 aluminum alloy.

Preparation of the partial conductors 60 and 62 by die casting decreases their cost significantly as compared with the prior electroforming approach. Moreover, the partial conductors 60 and 62 can be made from an aluminum alloy rather than a copper alloy, reducing its weight significantly. Weight reduction without loss of capability is always desirable in a flight vehicle, and even more so where the coaxial conductor is mounted on a gimballed device. A reduction in weight of a component mounted on the gimballed support also reduces the weight requirements for the mounts and motors to drive the gimballing action. The die casting approach also ensures that the pieces are reproducible with the same shapes and dimensions from piece to piece. Achieving electroformed parts of precise dimensions is possible, but requires more attention and has a lower yield of acceptable parts. Finally, the die cast parts are fabricated with integral flanges, lugs, and other features. In the prior approach, such structure was prepared separately and then joined to the outer conductor, increasing its weight and cost.

After the partial outer conductors 60 and 62 are formed, they are finish machined and plated, as desired, numeral 44 of FIG. 2. In general, die cast parts have good surface finishes. If there are small burrs and flashing, these are removed. There may be some portions whose mechanical tolerances are so tight that the tolerances possible with die casting cannot be relied upon, and these regions are machined. For example, in the coaxial conductor 20 of FIG. 3, a counterbore 70 must be made with very precise tolerances to permit mating with the adjacent structure, and this counterbore 70 is final machined. However, there are typically only a few areas that require machining, resulting in a low cost for the final parts.

It is often desirable to apply a coating to the surfaces of the partial outer conductors 60 and 62, to improve radio frequency electrical conduction, to inhibit oxidation or other environmental degradation, and also to permit soldering to the outer conductors 60 and 62. In a preferred approach wherein the outer conductors are made of an aluminum alloy, they are first given a base coating of about 0.0005–0.001 inch nickel and then a top coating of about 0.000030–0.000050 inch thickness of gold. These coatings can be applied by any operable process, such as plating.

Small dielectric supports 68, preferably made of poly(tetrafluoroethylene), are placed over the center conductor 22, numeral 46 of FIG. 2. These dielectric supports 68 maintain the centrality of the center conductor 22 to the outer conductor 24. The dielectric supports 68 create the air gap between the center conductor 22 and the outer conductor 24, which serves as the dielectric. The dielectric supports 68 are placed at approximately one-quarter wavelength positions along the length of the center conductor 22, so that energy is not lost through the dielectric supports 68.

The pieces 22, 60, and 62 are now ready for assembly to form the coaxial conductor 20. The center conductor 22, with dielectric supports 68 in place, is placed into the interior of the second partial conductor 62, numeral 48 of FIG. 2. The first partial conductor 60 is placed over the second partial conductor 62, and the partial conductors 60 and 62 are optionally joined mechanically with a connector such as the screw 30 extending between the lugs 32 and 34.

In some instances, the mechanically assembled coaxial conductor 20 may be used directly. Design features such as the asymmetric partial conductor design and the lip feature may be sufficient to prevent leakage of radio frequency energy from the coaxial conductor during use. In other instances, even greater sealing may be required. In that case, an external sealant may be applied over the longitudinally extending joint between two partial outer conductors 60 and 62. The preferred sealant is a thin coating of solder that also serves to further mechanically join the outer conductors together. It is normally difficult or not possible to solder directly to aluminum alloys, but the coating of nickel and gold discussed previously permits such soldering. In other instances, it may be possible to avoid the requirement of a mechanical connector and to rely entirely upon the solder coating to join the two partial outer conductors together.

Coaxial conductors of the configuration depicted in FIGS. 1, 3, and 4, and also of other configurations, have been prepared and tested. The fabrication approach and structure discussed herein have proved to be sufficient for conducting high frequency power with acceptably low losses.

Although particular embodiments of the invention have been described in detail for purposes of illustration, various modifications may be made without departing from the spirit and scope of the invention. Accordingly, the invention is not to be limited except as by the appended claims.

What is claimed is:

1. A coaxial cable conductor, comprising:

a center conductor having a preselected longitudinal shape;

a longitudinally split outer conductor, including a first partial outer conductor comprising less than half of the circumference of the outer conductor along its longitudinal length, a second partial outer conductor comprising the remaining portion of the circumference of the outer conductor along its longitudinal length and mating with the first partial outer conductor along two joints, the two outer conductors including a conforming overlapped lip in the two partial outer conductors at each of the joints, such that radio frequency energy has no straight line path to escape from the interior of the conductor, an end flange at an end of the outer conductor, a mechanical fastener that holds the two partial outer conductors together, and a metallic sealing layer applied over the external surfaces of the joints; and a plurality of poly(tetrafluoroethylene) dielectric supports that support the center conductor in a precise central location within the outer conductor, leaving a gap between the center conductor and the outer conductor.

2. The coaxial cable conductor of claim 1, further including a metallic coating on the external surface of the outer conductor.

3. The coaxial cable conductor of claim 1, wherein the outer conductor is made of aluminum.

* * * * *